US005092026A

United States Patent [19]

Klemmer et al.

[11] Patent Number: 5,092,026

[45] Date of Patent: Mar. 3, 1992

[54] CRIMP HEIGHT MONITOR

[75] Inventors: Robert Klemmer, Wheaton; Burke Crane, Lombard; Steven Wright, Glen Ellyn, all of Ill.

[73] Assignee: Molex Incorporated, Lisle, Ill.

[21] Appl. No.: 693,041

[22] Filed: Apr. 29, 1991

Related U.S. Application Data

[63] Continuation of Ser. No. 411,135, Sep. 22, 1989, abandoned.

[51] Int. Cl.[5] ..... H01R 43/04

[52] U.S. Cl. ..... 29/593; 29/705; 29/753; 29/863

[58] Field of Search ..... 29/593, 705, 707, 709, 29/715, 716, 714, 753, 751, 863; 72/26, 21, 19, 4

[56] References Cited

U.S. PATENT DOCUMENTS

| | | | |
|---|---|---|---|
| Re. 30,298 | 6/1980 | Keller | 340/680 |
| 2,654,060 | 9/1953 | Stovall | 317/246 |
| 3,257,652 | 6/1966 | Foster | 340/213 |
| 3,564,883 | 2/1971 | Koors | 72/19 |
| 3,665,742 | 5/1972 | Felt | 72/4 |
| 3,853,000 | 12/1974 | Barnett | 73/88.5 |
| 3,859,708 | 1/1975 | Keim | 29/715 |
| 3,883,938 | 5/1975 | Schmidt | 29/715 |
| 4,010,679 | 3/1977 | Dybel | 72/26 |
| 4,023,044 | 5/1977 | Miller | 72/4 |
| 4,218,817 | 8/1980 | Takano | 29/715 |
| 4,294,006 | 10/1981 | Bair | 72/707 |
| 4,552,002 | 11/1985 | Haenni | 72/389 |
| 4,555,799 | 11/1985 | Kodama | 382/8 |
| 4,606,205 | 8/1986 | Segredo | 72/19 |
| 4,633,720 | 1/1987 | Dybel et al. | 100/99 |
| 4,819,467 | 4/1989 | Graf et al. | 72/21 |
| 4,856,186 | 8/1989 | Yeomans | 29/720 |
| 4,914,602 | 4/1990 | Abe et al. | 72/3 |

FOREIGN PATENT DOCUMENTS

| | | | |
|---|---|---|---|
| 246579 | 12/1985 | Japan | 29/705 |

OTHER PUBLICATIONS

Goeller, J. E. et al., "Terminal Crimp Pressure Detector" From *IBM Technical Disclosure Bulletin*, vol. 27, No. 7A, Dec. 1984, pp. 3827, 3828.

*Primary Examiner*—Daniel C. Crane

*Attorney, Agent, or Firm*—Charles S. Cohen; Weiss, Stephen Z.

[57] ABSTRACT

An apparatus and a process are provided for assessing the quality of crimped electrical terminations of a terminal to a wire. The apparatus includes a strain gauge incorporated into a crimp press for measuring the strain generated in the press during each crimping cycle. The strain gauge is operatively connected to a controller which generates appropriate signals in response to strain measurements that are not within an acceptable range. The crimp press may further be operative to selectively adjust the crimp height or the length of the crimp stroke. The adjustment may be operatively connected to the controller, such that the crimp press is self-adjustiong and accommodates the gradual wearing of the crimp tools.

11 Claims, 8 Drawing Sheets

CRIMP HEIGHT MONITOR

This is a continuation of application Ser. No. 411,135 on Sept. 22, 1989, now abandoned.

BACKGROUND OF THE INVENTION

The subject invention relates generally to an apparatus and a process for ensuring a high quality crimp of an electrically conductive terminal to a wire. Electrical terminals include a wire mounting end which may be crimped into electrical and mechanical connection with a wire. The end of the wire may be stripped to expose the conductor therein. At least a first portion of the mounting end of the terminal will be crimped into electrical contact with the conductor of the wire. A second portion of the mounting end of the terminal may also be crimped into engagement with the insulated portion of the wire to contribute to strain relief of the electrical connection and to increase the force required to achieve a pull-out failure in the termination.

The crimping of the terminal to the wire is carried out in a crimping press. Prior art crimping presses take many forms, but most comprise at least one stationary tooling component, or anvil, and at least one movable tooling component, or punch. The stationary and movable components are cooperatively configured relative to one another to generate a secure crimping of the terminal to the wire. The movable component may be hydraulically or pneumatically powered or may comprise an electromechanical motor having a rotatable cam means for repetitively driving the movable tooling component.

Prior art crimp presses may also include means for feeding terminals and/or wires into appropriate positions relative to the tooling of the crimp press. More particularly, a plurality of terminals may be mounted to a carrier strip which facilitates the sequential feeding of terminals into and through the prior art crimp press. Wires also are urged into proximity to the tooling. When the terminal and the wire are properly positioned relative to one another, a crimping cycle will commence to crimp appropriate portions of the terminal around specified portions of the wire.

The degree of automation varies considerably from one prior art crimp press to the next. Many prior art crimp presses require the manual feeding of wires into a specified position relative to a terminal. Once the wire and terminal are properly positioned relative to one another and relative to the anvil, the operator will actuate a foot pedal which causes the crimp press punch to complete one cycle. Other prior art crimp presses include sensing means which actuate the punch of the crimp press in response to a sensed proper positioning of the end of the wire relative thereto. Still other prior art crimp presses include appropriate means for feeding, trimming, stripping and positioning the wires for automatic termination to crimpable terminals.

The quality of the crimped termination affects both the durability and the quality of the electrical connection. In particular, as noted above, a proper crimp will contribute to strain relief and will ensure that the normal mating or unmating forces exerted on the terminated wire do not damage the electrical connection. Additionally, the termination affects the ability of the wire and terminal to perform electrically. Preferably, the termination should be free of voids to ensure proper electrical performance. However, the exertion of too great a crimping force could significantly reduce the cross-sectional area or the wire in the vicinity of the crimp, and thereby affect the strength and current carrying performance of the wire.

The quality of a crimped termination can be affected by many factors. For example, the crimp press tooling wears in response to the significant crimping forces exerted during termination. The wear of the crimp press tooling will effectively cause the opposed dies to be further from one another at the end of the movement of the dies toward one another. Thus, tooling wear causes a gradual increase in the crimp height. The increased crimp height decreases the pull-out force required for failure of the termination and decreases the quality of the crimp by eventually creating voids in the termination. In some situations, the crimp height may be too low for the particular wire and terminal. This may occur when the crimp tooling is changed or when the crimp press is adjusted in some manner. A crimp height that is too low can create the above described restrictions in current carrying capabilities and can break strands of the conductor.

Terminations of unacceptable quality may also occur in more highly automated prior art crimp presses. For example, an improper feeding of terminals or wires can result in multiple terminations to a single wire. This can seriously damage the expensive tooling and cause considerable down time for the crimp press. In other situations, a crimp cycle may be completed even though a terminal has not been properly fed into the crimp press. Some crimping operations require a terminal to be crimped to two wires or to the combination of at least one wire and a grounding clip. The improper feeding of one of the wires or a grounding clip may result in an unacceptable product that will not be identified until a much later stage in a manufacturing or assembly process.

The potential for unacceptable terminations requires the use of some sort of quality assurance. In less automated crimping operations, the quality assurance is achieved by a technician who visually inspects each termination. This visual inspection may be supplemented with pull-out tests on all or a statistically significant sample of the terminations. Visual inspection becomes less practical in more highly automated crimping operations. In these situations, greater reliance may be placed upon the time-consuming and destructive pull tests. The prior art also includes very complex and expensive optical scanning means for assessing the quality of a crimped termination. Optical scanning is shown in U.S. Pat. No. 4,555,799 which issued to Kodama et al on Nov. 26, 1985. The apparatus of U.S. Pat. No. 4,555,799 is operative to assess the profile of the crimped termination, and to optically compare that profile to an acceptable range of optical profiles for the particular crimped termination. This complex and costly apparatus is far from foolproof. In particular, a crimped termination may have the specified profile even though a portion of a multi-strand wire has not been incorporated into the crimp or even though more or fewer than the specified number of wires have been crimped.

The punch and anvil of a crimp press require periodic replacement in view of the unavoidable wear on these parts. Generally, the owner/operator of a crimp press will change the tooling after a specified number of crimping cycles. This approach, is based upon estimates of crimp tool life as determined by past experiences with similar tooling. In many instances, this approach leads to a change in crimp tooling before necessary or the use of crimp tooling after a change should have been effected.

It is known to employ strain gauges with metal stamping equipment. Strain gauges operate on the principal that each cycle of a stamping apparatus causes minute deformations of various structural members in the apparatus. The typical strain gauge employs a transducer mounted to or incorporated into a selected spaced apart location on the stamping apparatus. The transducer is connected to means for measuring voltage across the transducer. The voltage will vary proportionally in response to the dimensional changes which occur during operation of the stamping apparatus. For example, many strain gauges employ piezoelectric crystals operatively connected to the transducer of the strain gauge. The voltage across the piezoelectric crystals will vary in proportion to the dimension changes therein. Strain gauges for these purposes are available through International Measurement and Control Company (IMCO) of Frankfort, Ill.

The above described strain gauges have been used in stamping operations to sense an irregular operation of the stamping apparatus and to determine if the hardness of the stock material being presented to the stamping apparatus varies from specified hardness levels. Examples of prior art strain gauges for these purposes are shown in Reissue Patent No. Re. 30,298 which was reissued to Keller on June 3, 1980 and in U.S. Pat. No. 3,257,652 which issued to Foster on June 21, 1966. General discussions of strain gauges and their construction are included in U.S. Pat. No. 2,654,060 which issued to Stovall, Jr., et al on Sept. 29, 1953 and in U.S. Pat. No. 3,853,000 which issued to Barnett et al on Dec. 10, 1974.

In view of the above, it is an object of the subject invention to provide apparatus and method for assessing the quality of crimp terminations.

It is another object of the subject invention to provide apparatus and process for providing higher quality crimp terminations throughout a longer life of the crimp tooling.

It is a further object of the subject invention to provide automatic apparatus for performing nondestructive testing of crimped terminations as part of the normal crimp operations.

Still a further object of the subject invention is to provide accurate crimp quality assessment apparatus and process than can employ available crimping equipment and technology.

An additional object of the subject invention is to provide means and process for automatically adjusting crimp tooling to account for wear.

SUMMARY OF THE INVENTION

The subject invention is directed to a method and an apparatus for assessing the electrical performance of crimp terminations of an electrically conductive terminal to a wire, and for assessing the performance of and wear to the crimp tooling which completes such electrical terminations. The apparatus of the subject invention includes means for measuring the forces encountered by and/or exerted by the punch of a crimp press during a crimping operation. These forces may be measured by a strain gauge mounted on or incorporated into the crimp press. The strain gauge may comprise a transducer mounted to the crimp press by a plurality of mounting means disposed in spaced relationship to one another. The strain gauge may be operative to convert dimensional changes in the transducer into electrical signals. More particularly, the strain gauge may comprise piezoelectric means incorporated into the transducer of the strain gauge. Voltage across the piezoelectric means will vary in proportion to dimensional changes.

The strain gauge or other such force measurement apparatus preferably is operative to recognize dimensional changes in the crimp press on the order of millionths of an inch. For example, presses subjected to forces on the order of 10,000 pounds per square inch may generate dimensional changes of about 400 micro inches which may be sensed by the force sensing means of the subject invention.

The strain gauge or other such force measuring means may be operatively connected to interface circuitry which in turn may be connected to control means, such as a microprocessor and appropriate display means. The display means may give a visual indication of the maximum measurement by the strain generated during each crimping operation.

The apparatus of the subject invention may further comprise crimp height adjustment means. In this regard, the crimp height defines the height of the termination at the completion of the crimping cycle. The crimp height adjustment means may comprise means for adjusting the length of the crimp stroke or cam means for adjusting the position of the crimp punch and anvil tooling relative to one another. The cam may define at least one wedge cam that is slidably movable relative to the ram or other such driving means for the crimp press.

The apparatus and process of the subject invention further comprises and employs control means for comparing the measured crimp forces with a range of acceptable crimp forces for the particular crimp height. The control means may comprise a microprocessor or computer connected to the strain gauge or other such force measurement apparatus by appropriate interface circuitry. The control means may further comprise display means for presenting measured data in readable form. The control means also may be operatively connected to the crimp height adjustment means. For example, control means of the subject apparatus may receive and compare data relating to both the strain as measured by a strain gauge and the crimp height as set by the crimp height adjustment means.

The crimp force data and the crimp height data is employed in the apparatus and process of the subject invention to assess the quality and anticipated electrical performance of the crimped termination. More particularly, it has been found that the performance of the crimped termination can be accurately deter1mined as a function of crimp force at any particular crimp height. For example, a crimped termination could achieve a specified height even though a significant portion of the strands of a conductor are external to the crimp. This defect, however, could be identified by a lower than specified crimp force for the specified height. Conversely, two wires could mistakenly be fed into a single terminal and crimped to a specified height. In this instance, however, the crimp force would be substantially greater than the specified crimp force. In both of these situations, a crimping force of less than or greater than a specified crimping force would readily be determined by the subject strain gauge or other such force measurement apparatus, and could be identified by the control means to indicate the unacceptability of the crimped termination. In response to the sensed condition, the control means may generate a reject signal to indicate a defective termination.

Variations of crimp force and/or crimp height do not necessarily indicate a clear defect in the termination process, such as a failure to feed a wire or terminal or a multiple feed thereof. Rather, unacceptable terminations are more likely to occur due to the gradual wearing of the crimp tooling. This wearing of the crimp tooling will gradually result in greater crimp heights and lower crimp forces. The wearing of crimp tooling can be continuously monitored by the apparatus of the subject invention. In particular, the subject apparatus can monitor the gradual drifting of the crimped termination out of a specified range of acceptable crimp forces and crimp heights. The apparatus may include means for generating an adjustment signal as the crimped terminations gradually drift toward and approach unacceptable crimp forces and crimp heights. Alternatively, the portions of the apparatus for measuring crimp forces may be operatively connected to the crimp adjustment means such that the positions of the punch and anvil crimp tooling or the length of the crimp stroke can be adjusted to bring the crimped terminations back into a central position within the specified ranges of measured data. The control means of the subject apparatus may further store the number of adjustments and/or magnitude of the crimp tooling adjustments to generate a change tooling signal when additional adjustments will not be acceptable and when repair and/or replacement of the tooling will be required.

The apparatus of the subject invention may further be operative to generate appropriate reports for indicating the quality of the crimped terminations and/or the trends in crimp tooling adjustments add crimp tooling life spans.

DETAILED DESCRIPTION OF THE PREFERRED EMBODIMENT

Figure 1:
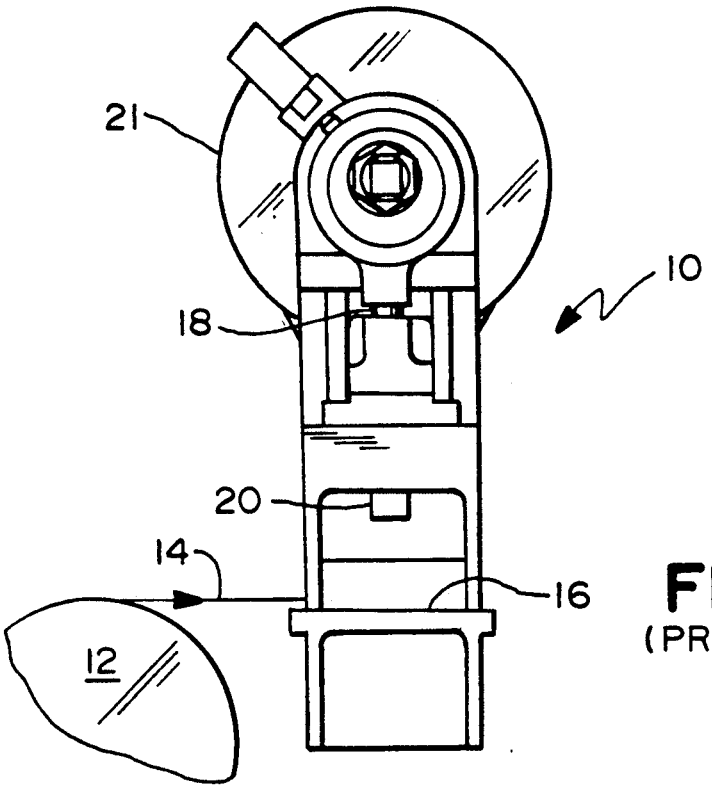
FIG.1 (PRIOR ART)
FIG. 1 is a front elevational view of a prior art crimp press.

A typical prior crimp press is identified generally by the numeral 10 in FIG. 1. The crimp press 10 is used in conjunction with a reel 12 for feeding a strip 14 of electrically conductive terminals. The terminals on the strip 14 are sequentially fed onto an anvil 16 of the crimp press 12 having appropriate tooling mounted thereon. The crimp press 10 further includes a ram 18 which also punch tooling 20 mounted thereto. The ram 18 is driven downwardly toward the anvil 16 under the action of an electromechanical motor 21 or appropriate hydraulic or pneumatic means to exert crimping forces relative to the tooling mounted to the anvil 16. The crimp press 10 is employed by sequentially advancing wires (not shown) into alignment with the terminals on the strip 14. When the wire and terminal are properly positioned relative to one another and relative to anvil 16, the ram 18 will be activated to urge the punch tooling 20 down toward the anvil 16.

Figure 2:
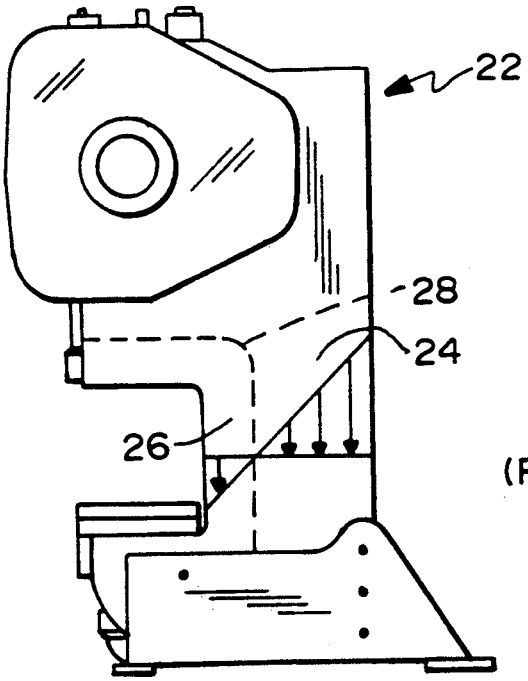
FIG.2 (PRIOR ART)
FIG. 2 is a side elevational view of a prior art crimp press showing variations in internal forces at different locations on the crimp press.

The crimp press 10 may generate forces of approximately 10,000 pounds per square inch during each crimping operation. The forces generated by the rapid movement of the ram 18 generate reaction forces in the frame of the crimp press. More particularly, as shown in FIG. 2, a prior art crimp press 22 includes a first region 24 which is subjected to compression as a result of each crimping cycle and a second region 26 which is subjected to tension. The line 28 identifies areas on the frame of the crimp press 22 that are subjected to neither tension nor compression. As illustrated schematically in FIG. 2, the magnitude of the compression or tension varies in proportion with the distance from the line 28. Thus, the greatest compression exists at the extreme rear of the frame of the crimp press 22.

Figure 3:
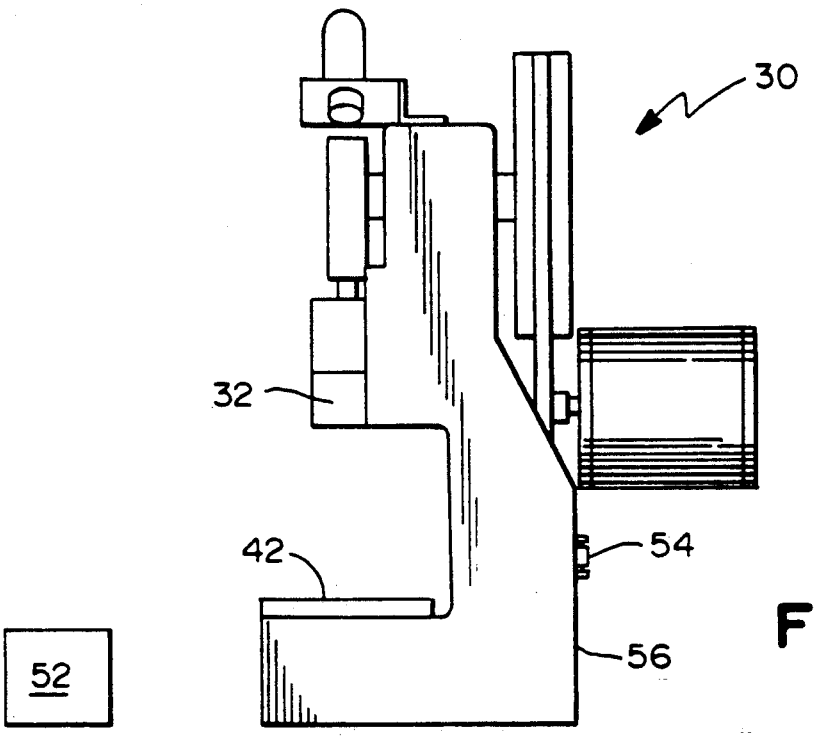
FIG. 3 is a side elevational view of a crimp press incorporating force sensors in accordance with the subject invention..
Figure 4:
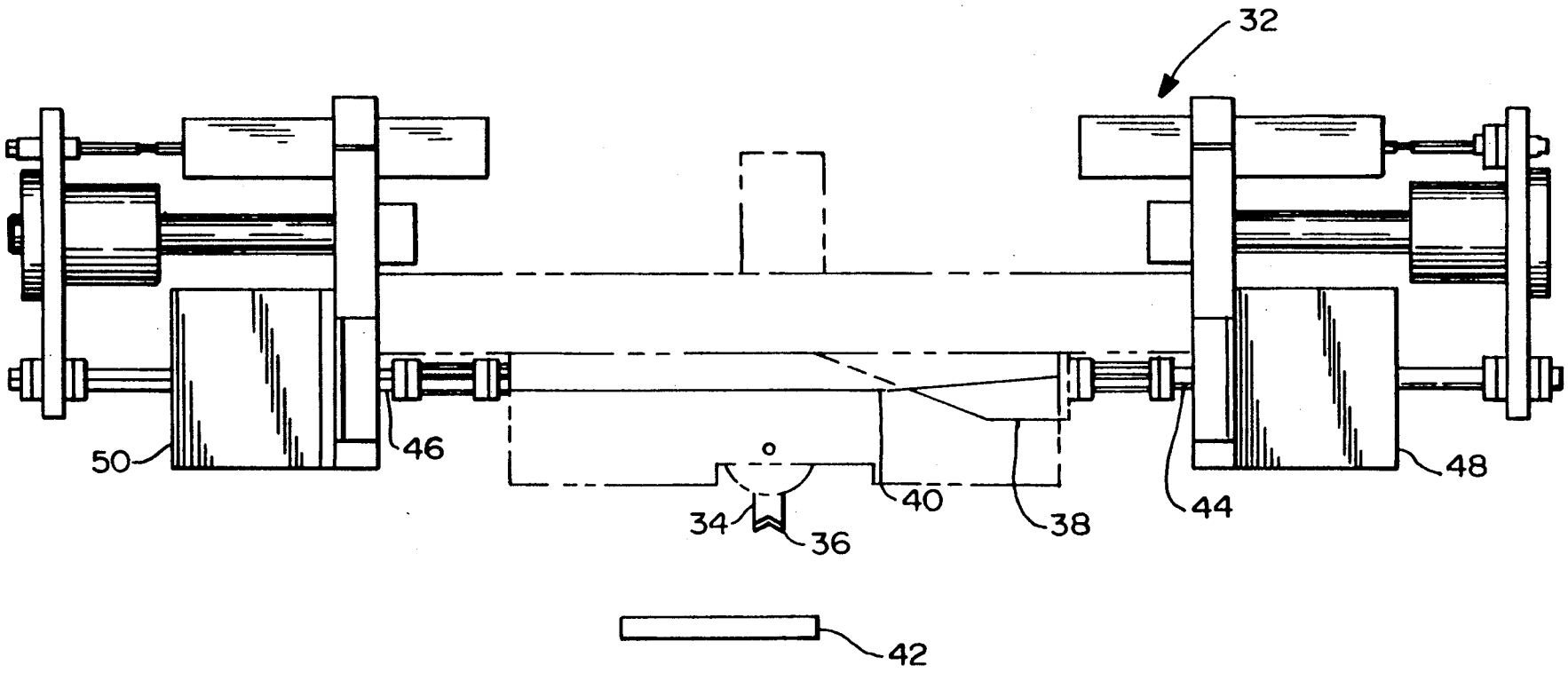
FIG. 4 is a front elevational view of a crimp tooling adjustment apparatus in accordance with the subject invention.
Figure 5:
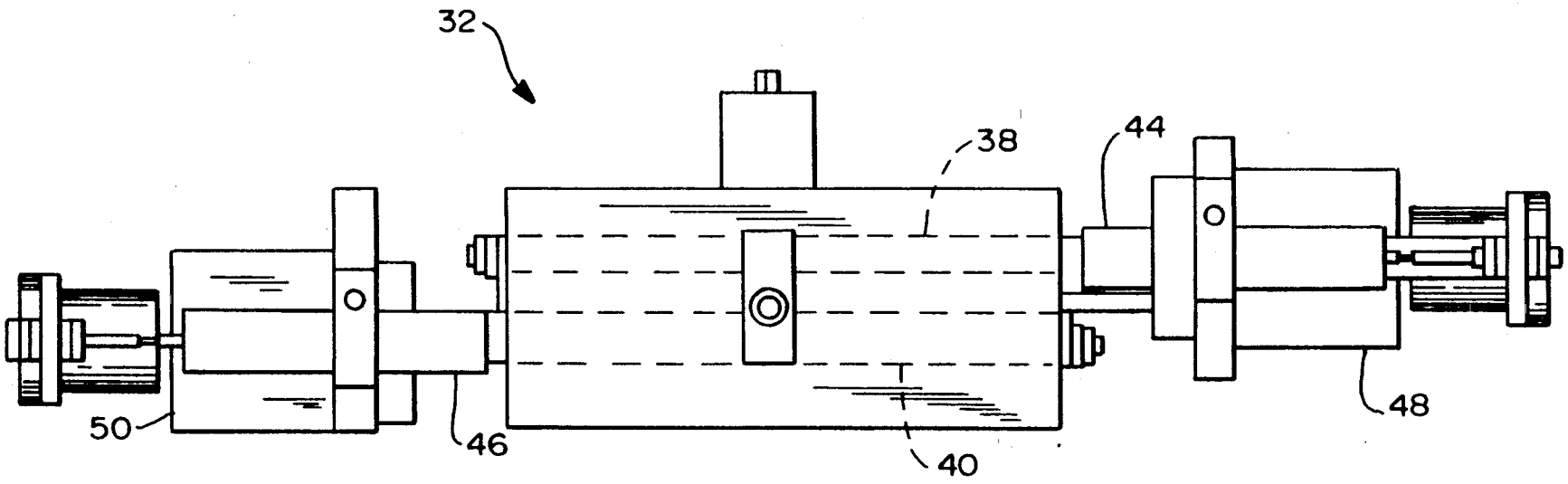
FIG. 5 is a top elevational view of the crimp tooling adjustment apparatus shown in FIG. 4.

A crimp press in accordance with the subject invention is identified generally by the numeral 30 in FIG. 3. The crimp press 30 is illustrated as being substantially identical to the crimp press 10 that had been shown in FIG. 1. However, the crimp press 30 is provided with an adjustable tooling assembly which is identified generally by the numeral 32 in FIG. 3, and which is illustrated in greater detail in FIGS. 4 and 5. More particularly, the crimp press 30 includes first and second independently adjustable punch dies 34 and 36 respectively. The punch 34 is operative to crimp a leading portion of a terminal to a region of a wire having insulation stripped therefrom. The crimp completed by the punch 34 will achieve the electrical connection of the terminal to the conductor in the wire. The punch 36 will generally define a greater crimp height and will be operative to crimp a rearwardly disposed portion of the terminal to an insulated region of the wire. The crimp completed by the punch 36 contributes to strain relief and a higher pull-out force for the termination.

The punch dies 34 and 36 are independently adjustable to alter their respective portions of the crimp height. More particularly, the tooling assembly 32 includes first and second adjustment cams 38 and 40 respectively for adjusting the height of the tooling 34 and 36 relative to the stationary anvil which is illustrated schematically in FIG. 3 and identified generally by the numeral 42. The adjustment cams 38 and 40 are mounted respectively to drive rods 44 and 46 which in turn are mounted to stepper motors 48 and 50 respectively. The motors 48 and 50 are operatively connected to control means 52 which is not illustrated in FIGS. 4 and 5, but which is shown schematically in FIG. 3. As will be explained further below, the control means 52 is operative to generate electrical signals that will cause the motors 48 or 50 to drive the rods 44 and 46 respectively and to thereby move the cam wedges 38 and 40 respectively. The relative position of the inclined cam wedges 38 and 40 will alter the elevational position of the punch dies 34 and 36 relative to the anvil 42, and will thereby alter the crimp height. The controller 52 also receives signals from elsewhere on the crimp press 30, as explained herein, that generate the signals for controlling the crimp adjustment motors 48 and 50.

Figure 7:
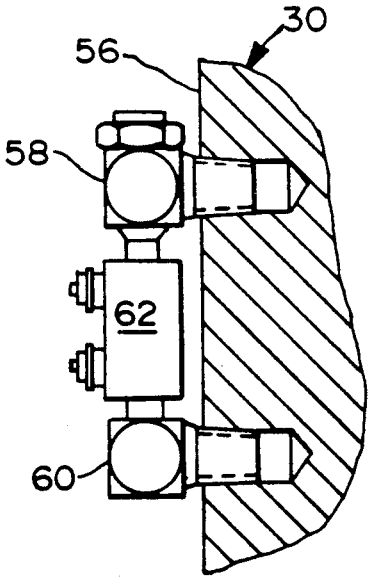
FIG. 7 is a cross-sectional view taken along lines 7—7 in FIG. 6.
Figure 6:
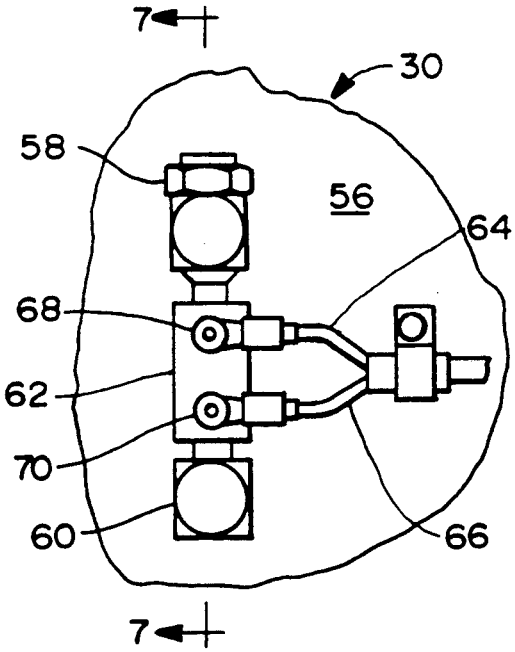
FIG. 6 is a front elevational view of a strain gauge mounted to a crimp press.

With reference to FIG. 3, the crimp press 30 further includes a strain gauge 54 mounted to the rear face 56 of the crimp press 30. The strain gauge 54 which is illustrated more clearly in FIGS. 6 and 7, includes top and bottom mounting brackets 58 and 60 and a transducer 62 mounted therebetween. Wire leads 64 and 66 are mounted to spaced apart terminals 68 and 70 respectively on the transducer 62. The wires 64 and 66 extend to the controller 52 which is operative to generate a current through the wires 64 and 66 and through the transducer 62. The transducer 62 includes piezoelectric means which will be responsive to minute dimensional changes between the mounting brackets 58 and 60 to proportionately alter the voltage across the terminals 68 and 70. A preferred strain gauge for this purpose is sold by International Measurement and Control Company (IMCO) and is referred to commercially as Ton-Limit Detectors. The controller 52 is operative to store the value of the maximum strain measured by the strain gauge 54.

Figure 8:
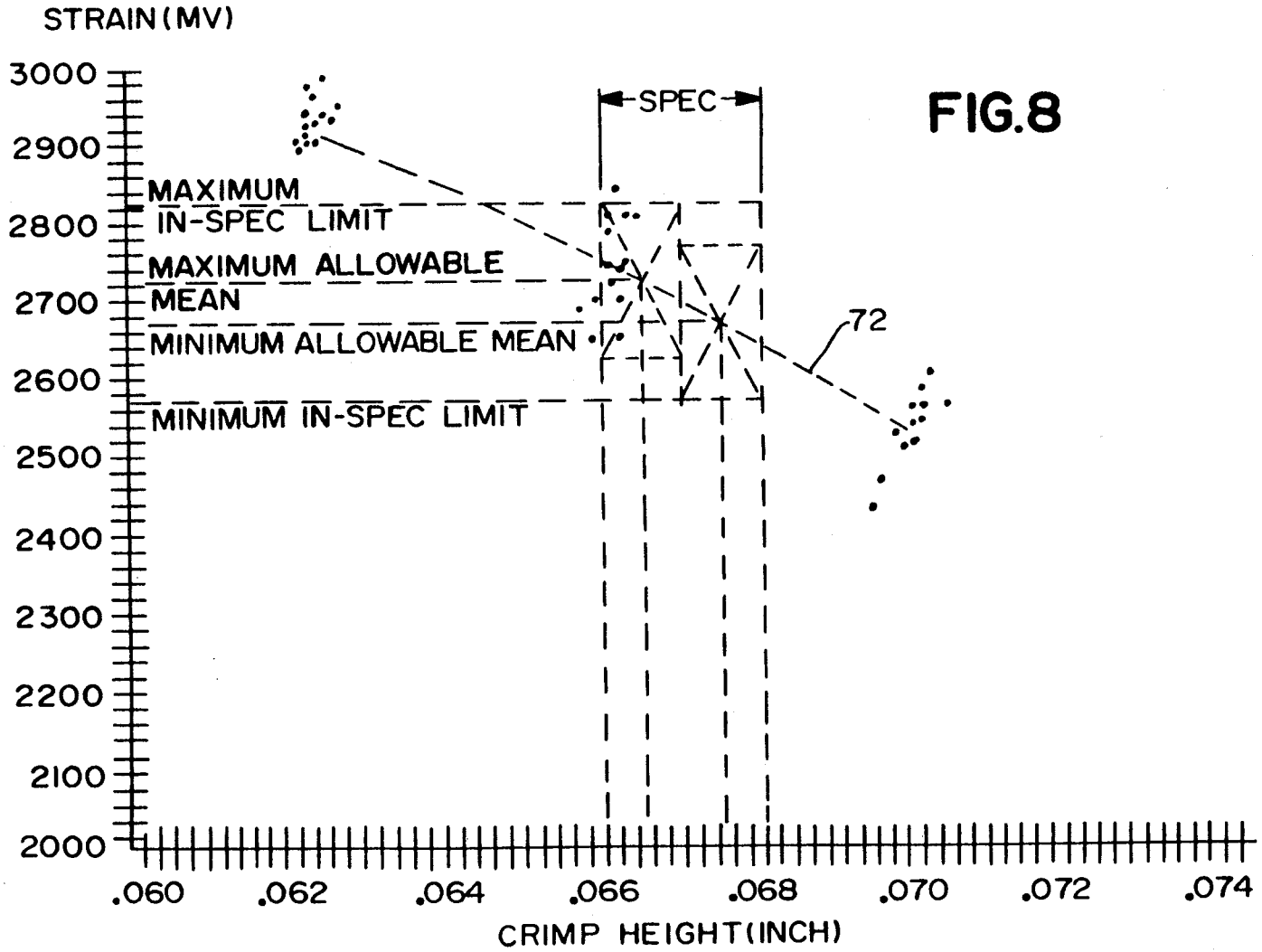
FIG. 8 is a graph showing a comparison of strain versus crimp height.
Figure 9:
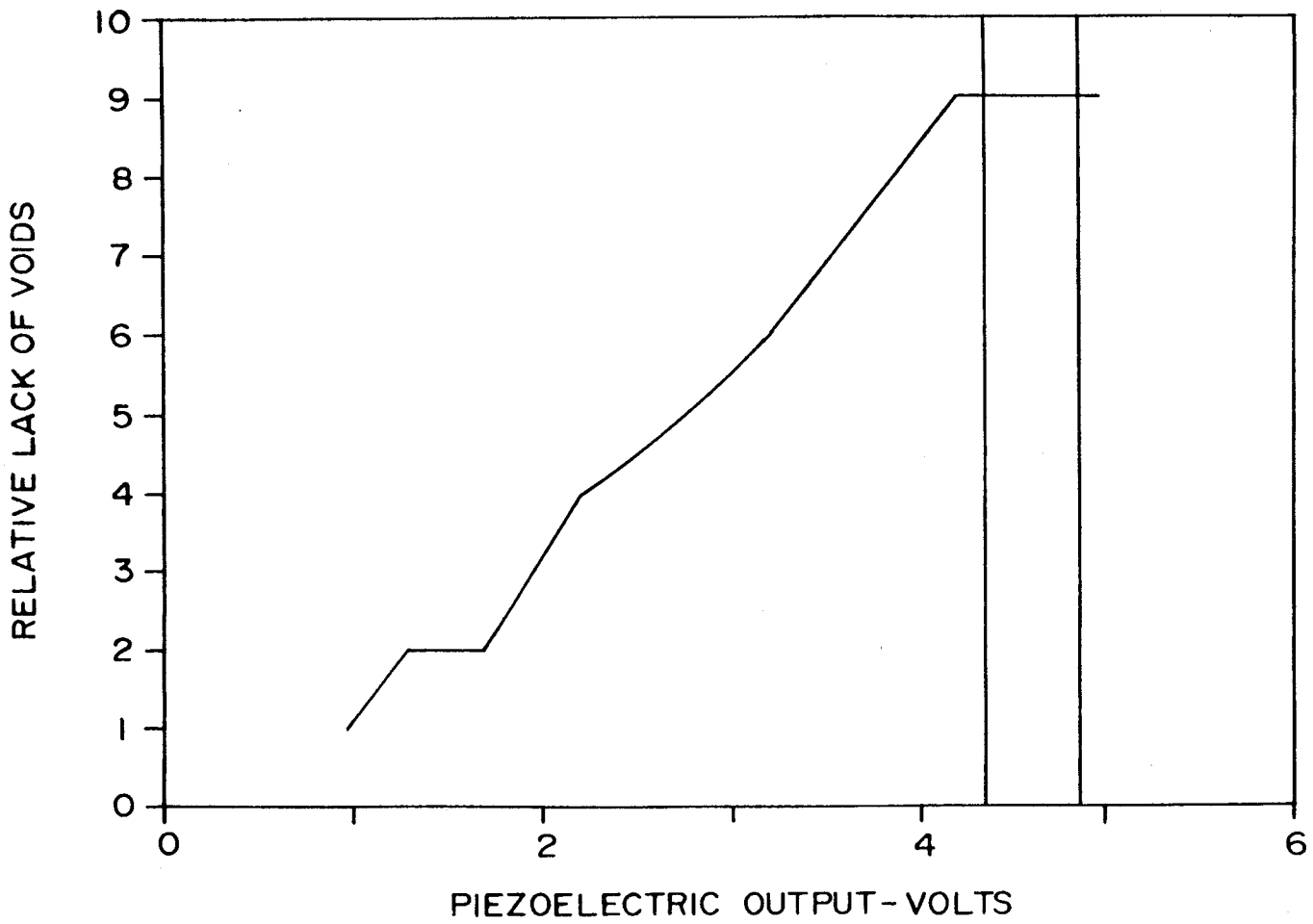
FIG. 9 is a graph showing a comparison of voids in a crimp termination versus strain.
Figure 10:
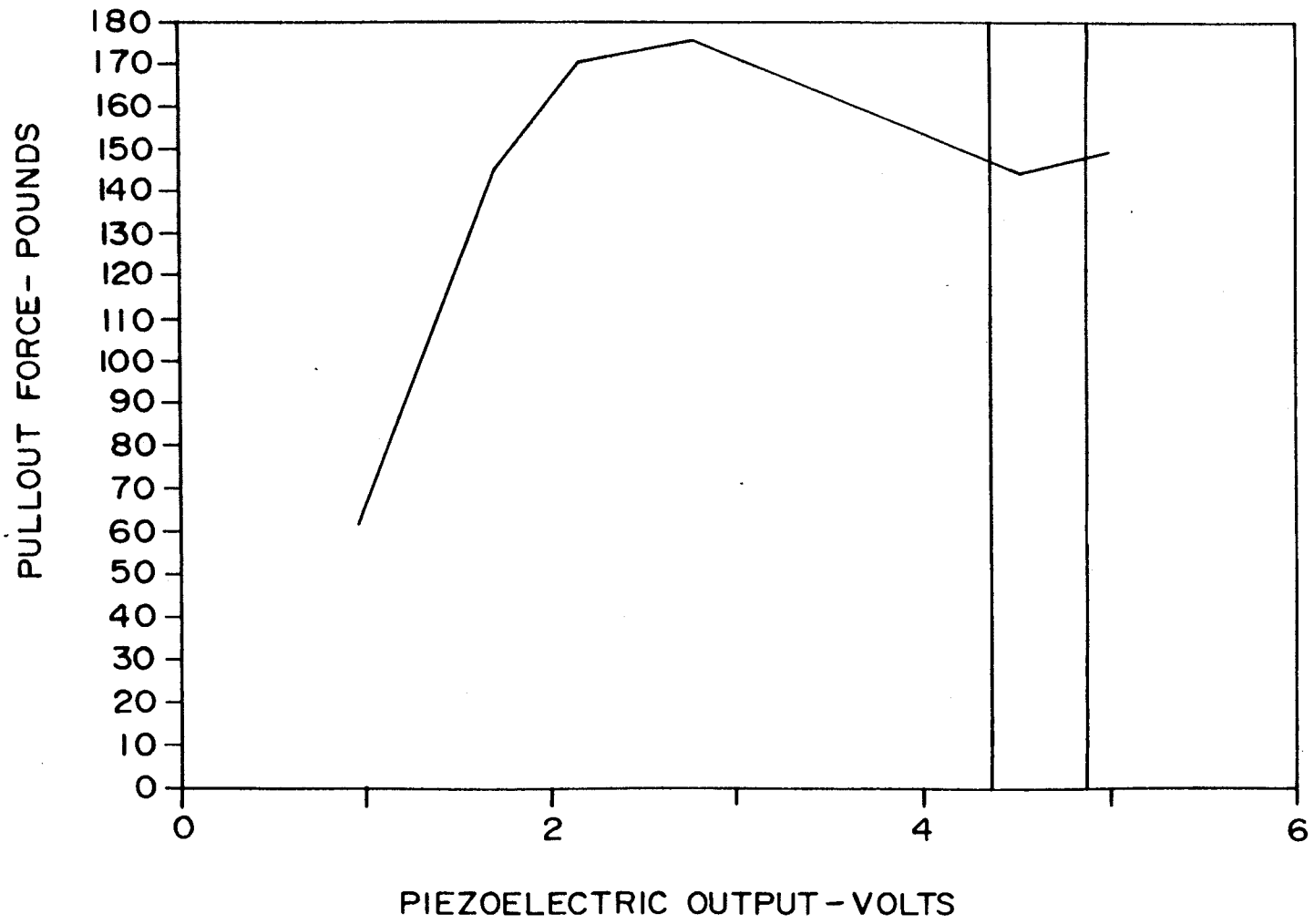
FIG. 10 is a graph comparing pullout force versus strain.

The use of the strain gauge 54 and the adjustable crimp height tooling assembly 32 in the crimp press 30 can be illustrated graphically with reference to FIGS. 8–11. In particular, FIG. 8 shows the results of tests where strain was measured at three different crimp height settings on a crimp press. The actual crimp height was then measured with a micrometer after each crimp. The line 72 shown in FIG. 8 represents the measured strain versus crimp height distribution. Within each group, it was found that the distribution around the mean was very predictable, thereby indicating that the strain measured during a crimping operation would be a good indication of the actual crimp height. Other similar tests were performed for crimped terminations where the specified crimp height was required to be between 0.080 inch and 0.084 inch. For these respective ranges of crimp height, it was determined that the piezoelectric output in volts would be between 4.2 and 4.4. FIGS. 9 and 10 show tests where piezoelectric output in volts was compared to the standard prior art measurements of crimp quality. In particular, FIG. 9 compares piezoelectric output in volts to a measurement of the relative lack of voids. The vertical lines in FIG. 9 identify the minimum and maximum ranges of piezoelectric output which correspond to crimps in the specified range. The crimp height of the press was varied to achieve lower strain readings. The crimps produced by these readings were then analyzed to determine the relative lack of voids. Piezoelectric output values below the values corresponding to the acceptable crimp height range exhibited a decreased lack of voids or an increased presence of voids, which would be indicative of a poorer electrical performance for the termination. FIG. 10 compares the piezoelectric output to the pull-out force. In particular, the pull-out force for tests yielding piezoelectric output within the specified range all were above 110 pounds which is the minimum standard pull-out force for terminations of this type.

Figure 11:
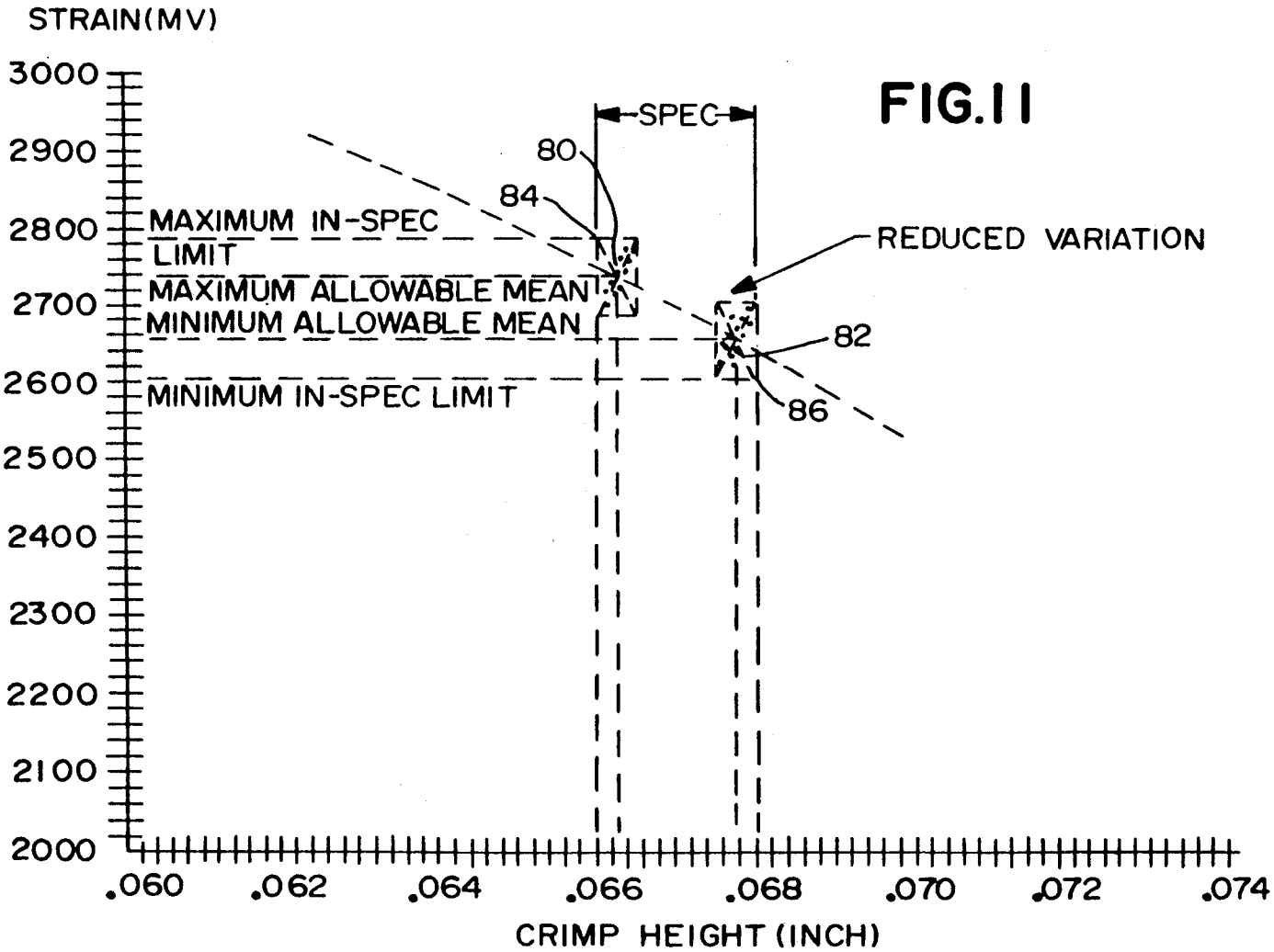
FIG. 11 is a graph similar to FIG. 8, but showing alternate data.

FIG. 11 is similar to FIG. 8 but shows a tighter distribution of data about the mean. This Figure is provided to illustrate an approach to using the relationships described herein with the apparatus 30 described and illustrated with respect to FIGS. 3–7. In particular, the array of data identified generally by the numeral 80 in FIG. 11 shows the distribution of strain and crimp height that might exist for a crimp press employing new tooling. As the tooling begins to wear, the crimp height increases and the mean strain sensed by the strain gauge 54 will gradually drift to lower levels indicating a wearing of the tooling. When the strain gauge 54 sends data to the controller 52 indicating that the mean strain has decreased to the minimum allowable mean as indicated by location 82 in FIG. 11, an appropriate signal will be generated by the controller 52 to indicate a need for adjusting or replacing the tooling. The signal generated by the controller 52 shown in FIG. 3 may be operative to actuate the crimp height stepper motors 48 and/or 50 to adjust the tooling 34 and 36. In particular, the motors 48 and/or 50 will cause the rods 44 and/or 46 respectively to advance linearly and thereby reposition the respective cam wedges 38 and/or 40. This will effectively adjust the punches 34 and 36 to lower respective positions relative to the anvil 42 depicted in FIG. 3. The adjustment will cause the mean strain to return approximately to location 80 depicted in FIG. 10 which corresponds to the minimum specified crimp height that can be accepted without unnecessarily restricting the current flow through the termination. The controller 52 depicted in FIG. 3 will be operative to permit a specified number of such adjustments without a detailed inspection by operating personnel. However, after the maximum number of adjustments has been reached, any subsequent downward drifting of the mean strain to the minimum acceptable mean 82 will generate a change tool signal requiring inspection and/or replacement of the tooling.

FIG. 11 further shows the maximum acceptable strain and the minimum acceptable strain. Values of measured strain beyond these limits will be rejected regardless of the ongoing assessment of the mean strain. For example, a strain which exceeds the maximum specified limit 84 set forth in FIG. 10 may be indicative of a jam or broken tool in the crimping press 30 shown in FIG. 3. This will immediately generate a reject signal that will either identify a particular termination for rejection and/or terminate the operation of the press 30. Similarly, a reading below the minimum specified strain level 86 will indicate either a crimp that did not engage all strands of the conductor in a wire or where either a wire or a terminal was not properly fed. As noted above, this will generate an immediate reject signal to indicate that the particular terminated wire below the minimum specified strain should be rejected and possibly to indicate the need to check the crimp press.

In summary, a crimp press for crimped electrical terminations is provided with a strain gauge incorporated therein. The strain gauge is operatively connected to a controller which identifies the strain for each crimp and which calculates the means strain over a selected number of sequential crimps. A strain reading either above or below a specified range will cause the generation of a signal for rejecting that particular terminal. The controller may further generate a signal to require inspection of either the rejected part or the crimp press tooling. As the tooling gradually wears, the mean will drift toward a minimum allowable mean. As the minimum allowable mean is reached, a signal will be generated indicating the need to adjust the tooling. The crimp press may further include tooling adjustment means incorporated therein. The tooling adjustment means may be operatively connected to the controller such that adjustments to the crimp height will be effected automatically when the mean strain approaches a minimum allowable mean. The controller may be operative to generate an appropriate signal after a selected number of crimp adjustments or after adjustments equaling a selected distance have been carried out.

While the invention has been described with respect to a preferred embodiment, it is apparent that various changes can be made without departing from the scope of the invention as defined by the appended claims. In particular, force measurement means other than piezoelectric strain gauges may be employed to measure the force encountered during a crimping operation. Additionally, the crimp presses and the adjustments to the crimp heights may take forms other than those specifically illustrated herein

I claim:

1. A crimp press for crimping an electrically conductive terminal to a wire, said press comprising a frame, an anvil mounted to the frame and having means for receiving at least one said terminal and at least one said wire thereon, a punch movable relative to the frame and the anvil for crimping selected portions of the terminal into engagement with the wire, wherein the improvement comprises:

force measurement means mounted to said crimp press for measuring the maximum force generated in the crimp press during each cycle of the punch; and control means operatively connected to the force measurement means for comparing the measured force to an acceptable range of forces and for generating a signal in response to said measured force being outside the acceptable range;

wherein the control means further comprises averaging means for calculating the average maximum force over a selected number of crimp cycles, said control means further being operative to compare the average maximum force to a minimum acceptable average maximum force and for generating a signal in response to an average measured maximum force being less than the minimum acceptable average maximum force.

2. A crimp press for crimping an electrically conductive terminal to a wire, said press comprising a frame, an anvil mounted to the frame and having means for receiving at least one said terminal and at least one said wire thereon; crimp height adjustment means for providing a selectively adjustable crimp height, a punch movable relative to said frame and said anvil for crimping selected portions of the terminal into engagement with the wire, wherein the improvement comprises:

force measurement means mounted to said crimp press for measuring the maximum force generated in the crimp press as a result of said punch crimping said terminal during each cycle of the punch, said force measurement means comprising piezoelectric means for converting dimensional changes in the crimp press to electrical signals; and control means for storing an acceptable ranges of forces corresponding to crimp heights and operatively connected to the force measurement means for comparing the measured maximum force to an acceptable range of forces for a selected crimp height and for generating a signal in response to said measured maximum force being outside the acceptable range for the selected crimp height.

3. A crimp press as in claim 2 wherein the adjustment means comprises a motor means for effecting the adjustment, the motor means being operatively connected to the control means.

4. A crimp press as in claim 2 wherein the adjustment means comprises means for adjusting the position of the punch relative to the anvil.

5. A crimp press as in claim 4 comprising an insulation punch for crimping a first portion of the terminal to insulation on the wire and a conductor punch for crimping a second portion of the terminal to a conductor in the wire, said crimp height adjustment means being operative to independently adjust the position of the insulation punch and the conductor punch in response to signals from the control means.

6. A crimp press as in claim 2 further comprising visible display means operatively connected to the control means for producing a visible display of forces sensed by the force sensing means.

7. A crimp press as in claim 2 wherein the force measurement means is mounted to the frame of the crimp press.

8. A crimp press as in claim 2 further comprising visible display means operatively connected to the control means for producing a visible display of forces sensed by the force sensing means.

9. A method for measuring the quality of a crimp termination of an electrically conductive terminal to a wire, said method comprising the steps of presenting at least one terminal to a crimp press, presenting a wire into proximity with the terminal and operating the crimp press for crimping selected portions of the terminal into engagement with the wire, wherein the improvement comprises:

measuring the maximum forces generated by the crimp press during each of a selected plurality of sequential operations of said crimp press;

storing the value of the measured force for each of the selected plurality of sequential operations of the crimp press;

averaging the maximum forces measured in said selected plurality to determine a measured average maximum force;

comparing said average to an acceptable range of averages; and generating an adjustment signal in response to a measured average maximum crimp force being outside the acceptable range of average crimp forces.

10. A method as in claim 6 further comprising the step of automatically adjusting the movement of the punch in response to an average measured force outside the acceptable range of averages.

11. A method as in claim 10 further comprising the step of counting the number of adjustments automatically made to the movement of the punch and generating a change tool signal after making a selected number of adjustments.

* * * * *